US007855349B2

(12) United States Patent
Kechel

(10) Patent No.: US 7,855,349 B2
(45) Date of Patent: Dec. 21, 2010

(54) PROCESS AND DEVICE FOR SORTING OF GOODS

(75) Inventor: Ottmar Kechel, Stockach (DE)

(73) Assignee: Siemens Aktiengesellschaft, Munich (DE)

( * ) Notice: Subject to any disclaimer, the term of this patent is extended or adjusted under 35 U.S.C. 154(b) by 200 days.

(21) Appl. No.: 12/179,683

(22) Filed: Jul. 25, 2008

(65) Prior Publication Data

US 2009/0026118 A1 Jan. 29, 2009

(30) Foreign Application Priority Data

Jul. 25, 2007 (DE) ..... 10 2007 034 660
Apr. 3, 2008 (DE) ..... 10 2008 017 140

(51) Int. Cl.
*B07C 5/00* (2006.01)

(52) U.S. Cl. ..... 209/584; 209/551; 209/900

(58) Field of Classification Search ..... 209/3.3, 209/551, 583, 584, 900; 700/223–226
See application file for complete search history.

(56) References Cited

U.S. PATENT DOCUMENTS

| | | | | |
|---|---|---|---|---|
| 2,531,786 | A * | 11/1950 | Rembold | 209/547 |
| 5,287,271 | A * | 2/1994 | Rosenbaum | 705/8 |
| 5,292,008 | A * | 3/1994 | Sansone et al. | 209/584 |
| 6,822,182 | B2 | 11/2004 | Kechel | |
| 7,004,396 | B1 * | 2/2006 | Quine et al. | 235/475 |
| 7,364,079 | B2 * | 4/2008 | Raney et al. | 235/462.01 |
| 2003/0208298 | A1 * | 11/2003 | Edmonds | 700/224 |
| 2005/0216118 | A1 * | 9/2005 | Conard et al. | 700/223 |
| 2006/0283784 | A1 * | 12/2006 | Roth et al. | 209/584 |
| 2008/0067114 | A1 * | 3/2008 | Chastain et al. | 209/552 |

FOREIGN PATENT DOCUMENTS

| | | | |
|---|---|---|---|
| DE | 19650875 | C1 | 10/1997 |
| DE | 4000603 | C2 | 4/1998 |
| DE | 10039419 | C1 | 10/2001 |
| DE | 10344576 | B3 | 12/2004 |
| DE | 102004037363 | A1 | 3/2006 |
| EP | 0595596 | A2 | 5/1994 |
| EP | 0773841 | B1 | 5/1997 |
| EP | 0948416 | B1 | 10/1999 |
| WO | 2005053864 | A1 | 6/2005 |

* cited by examiner

*Primary Examiner*—Joseph C Rodriguez

(57) ABSTRACT

A sorting installation uses predetermined separating elements which may be differentiated from the articles. The sorting installation ejects the articles as well as the separating elements into the dispensing containers such that after ejection the articles and separating elements are arranged in each dispensing container in one respective sequence. In this connection, the sorting installation ejects each article depending on the respectively measured feature value into one of the dispensing containers. The sorting installation establishes which possible feature values the measuring device has actually measured at least once. For each such actually measured feature value, the sorting installation inscribes a separating element with an identification mark for this value. The sorting installation ejects the separating elements and articles such that in front of a separating element with an identification mark for a feature value, all articles with this feature value are located first in the sequence in each dispensing container.

11 Claims, No Drawings

PROCESS AND DEVICE FOR SORTING OF GOODS

CROSS REFERENCE TO RELATED APPLICATIONS

This application claims priority of German application No. 10 2007 034 660.5 DE filed Jul. 25, 2007 and German application No. 10 2008 017 140.9 DE, which are both incorporated by reference herein in its entirety.

FIELD OF INVENTION

The invention relates to a method and a device for sorting articles according to a feature, in particular postal items according to their respective delivery address.

SUMMARY OF INVENTION

In EP 0773841 B1 it is disclosed how postal items are ejected into different dispensing compartments of a sorting installation in a sequence depending on the respective delivery address. The articles are in this case postal items, which are provided with one respective delivery address. A measuring device of the sorting installation scans the respective delivery address. The postal items are ejected having been sorted according to their respective delivery address. So that a delivery person rapidly finds out which postal items are to be assigned to which delivery address, identification means are ejected with the postal items. Each identification means carries a code, for example a consecutive number. An allocation table stores which code corresponds to which postal item.

This method makes it necessary to store a complete set of identification means. If an identification means is missing, a new identification means has to be provided with the same code, so that the method functions.

A method with the features of the preamble of independent claims is disclosed in U.S. Pat. No. 6,822,182 B1. In U.S. Pat. No. 6,822,182 B1, it is proposed to use similar separating elements (in this case known as "dividers"). The sorting installation ejects standard letters ("letters") and large letters ("flats") together into the dispensing container. In this case the postal items are ejected so that they are sorted according to delivery zone after ejection. The delivery zone is, for example, a zone with a specific "ZIP+4 code". If, in the sequence in which the postal items are ejected into a dispensing container, two similar postal items to different delivery zones were to pass directly behind one another, a separating element is inserted between these postal items. If, however, two successive postal items are different (for example first a standard letter, then a large letter), no separating element is inserted therebetween.

The method known from U.S. Pat. No. 6,822,182 B1 requires subsequent manual handling, in order to detect which articles are ejected into which dispensing containers.

In DE 10344576 B3 a method is disclosed in order to combine flat postal items manually. The postal items have already previously been sorted. Depending on their delivery addresses, the postal items are divided into different sections. The sections are subdivided relative to one another by separating cards. The postal items, together with the separating cards, are ejected into collecting containers.

The object of the invention is to provide a method and a sorting installation comprising the features of the preamble of the independent claims, which subsequently require less manual handling when the ejected articles are processed further.

The object is achieved by a method and sorting installation comprising the features of the independent claims. Advantageous embodiments are specified in the dependent claims.

The method uses a sorting installation which has a measuring device and a plurality of dispensing containers. For each article to be sorted, the measuring device measures, which value the feature adopts for this article. The sorting installation uses predetermined separating elements which may be differentiated from the articles. The sorting installation ejects the articles as well as the separating elements into the dispensing containers such that, after ejection, the articles and the separating elements are arranged in each dispensing container in one respective sequence. In this case, the sorting installation ejects each article into one of the dispensing containers, depending on the respectively measured feature value. It is possible that the sorting installation ejects the articles successively in the same sequence. It is also possible that the sorting installation rearranges the articles after ejection, so that the sequence is created. The sequence created is a sequence in a specific viewing direction.

According to the invention, for each value of the feature, the sorting installation inscribes one respective separating element with an identification mark for this value.

The sorting installation ejects the inscribed separating elements and articles such that all articles with the same feature value are arranged directly behind one another. Behind these articles with a coinciding feature value, a separating element is arranged, which is provided with an identification mark for this feature value. "Directly behind one another" means that no article with a different feature value is located between articles with the same feature value.

The invention also makes it possible to use the sorting installation even when the sorting installation has fewer dispensing containers than the feature has possible values. The invention eliminates the requirement to store a complete set of separating elements for ejection, which have previously been characterized by one respective feature value. It also eliminates the need to establish manually after ejection which articles are located behind which separating element.

The invention makes it possible to adapt the sorting process rapidly when an additional feature value is added. It is sufficient if this new value is ascertained during the sorting process and, as a result, the sorting installation labels an additional separating element.

As a result of the invention, it is not necessary to detect or predetermine in advance how many articles have which feature value. This information is instead automatically detected by the sorting installation during the sorting process.

As a result of the invention, similar separating elements may be used. The sorting installation provides the separating elements with identification marks for the feature value, only during the sorting process. As a result, the necessity of keeping identified separating elements available is eliminated.

Preferably, the sorting installation establishes which possible feature values the measuring device has actually measured at least once. It may arise that a possible feature value does not actually appear on any article. Only for each value which is actually present does the sorting installation label a separating element with an identification mark for this value.

Preferably, the sorting installation provides each separating element for a feature value with the following information:

- an identification mark for the feature value which all articles have, which are arranged in the sequence in front of the separating element and behind the previous separating element and/or a wall of the dispensing container, the number of articles which have this feature value and are arranged in front of the separating element, and optionally the time when these articles have been ejected.

This embodiment eliminates a manual monitoring operation. In particular, it is not necessary after ejection to count manually how many articles, and with which feature value, are in a dispensing container.

The following may be used as a feature of the articles, for example:

the color of the article, a geometric dimension, a physical parameter, for example the weight thereof or the surface characteristic thereof, an identification mark printed onto the article, for example a destination address, to which the article is to be transported, and the nature of the article or the type of article.

The invention is described hereinafter with reference to an exemplary embodiment.

In the exemplary embodiment, the articles are postal items. Each postal item is provided with one respective delivery address. This delivery address functions as the feature value of each article.

A sorting installation is used in order to sort the articles, i.e. the postal items. The postal items pass through this sorting installation. The sorting installation has a scanner which functions as the measuring device, as well as dispensing containers. The scanner scans each postal item and attempts to identify the delivery address of the postal item in the image produced by scanning. Initially, a method of "optical character recognition" (OCR) is applied to the image, in order to identify automatically the delivery address. If this does not succeed, the image is forwarded to a video coding station. An operator scans the delivery address and at least partially enters the scanned result, for example only the postcode or a "ZIP+4 code".

The sorting installation ejects each postal item into one of the dispensing containers. Such a dispensing container may be a portable container which is placed on a support, and which the sorting installation fills and which is subsequently transported away.

It is also possible that the sorting installation has a plurality of dispensing compartments. These dispensing compartments function in the same manner as the dispensing containers and are fixedly connected to the sorting installation. The sorting installation ejects the postal items into the dispensing compartments. The ejected postal items are removed from the dispensing compartments and additionally, for example, transferred into a portable container.

It is also possible that the sorting installation ejects each postal item onto a conveyor belt, which transports the postal items away.

After ejection, the postal items are arranged in a specific sequence in the dispensing containers. For example, the postal items are flat articles, for example letters and postcards and catalogues. After ejection, one respective stack of flat postal items is located in each dispensing container. The postal items may also be packages which are respectively ejected in one sequence per dispensing container.

In the exemplary embodiment, the sequence in which the postal items and separating elements are located in a dispensing container after ejection is the same as the sequence in which these postal items and separating elements are ejected into the dispensing container. After the sorting installation has ejected the postal items for a destination zone into a dispensing container, the sorting installation "knows" how many postal items it has ejected for this destination zone.

The ejected postal items are subsequently transported to different destination zones. For example, depending on their respective delivery address, said postal items are sent to the sorting center which is appropriate for the delivery address. Preferably, a plurality of postal items are transported together to the same sorting center. Thus these postal items are ejected so that they land in the same dispensing container—even when they have different delivery addresses, for which the same sorting center is appropriate. Moreover, the postal items are preferably presorted according to their delivery addresses, so that the postal items to different delivery addresses of the same sorting center are arranged after ejection one behind the other in the dispensing containers.

In the exemplary embodiment, the postal items are sorted according to their destination zones. Each delivery address is associated with one of the possible destination zones. A destination zone may be a sorting center. It is also possible that the region for which a sorting center is appropriate is subdivided into a plurality of destination zones. In an extreme case, each delivery address is a separate destination zone. The possible destination zones are associated with the method. The destination zone of the delivery address with which a postal item is provided, functions in the exemplary embodiment as the feature value of the article.

A sorting plan is predetermined. This sorting plan establishes for each destination zone, into which dispensing container the postal items to a delivery address of this destination zone have to be ejected.

In the exemplary embodiment, the postal items have a considerably greater number of different destination addresses than the sorting installation has dispensing containers. Thus it is necessary to eject postal items to different destination zones into the same dispensing container. In order to be able to differentiate the postal items to different destination zones in a dispensing container, the sorting installation automatically inserts separating elements between the postal items to different destination zones. These separating elements differ visually from all postal items, for example by a different color and/or in that they are larger than the postal items. A separating element has preferably the form of a card, which has a sufficiently high degree of rigidity. The card may, for example, be made from paper, cardboard or plastic.

The postal items are ejected into each dispensing container such that after ejection they are located in a specific sequence in the dispensing container. This sequence is designed such that after ejection all postal items to a delivery address ZG-1 are positioned first, then as a first separating element a separating element for ZG-1, then all postal items to a delivery zone ZG-2, then as a second separating element a separating element for ZG-2, then all postal items to a delivery zone ZG-3, then as a third separating element a separating element for ZG-3 and so forth.

According to the invention, during the sorting process, the sorting installation inscribes each separating element and namely preferably with the following information:

an identification mark for a destination zone ZG, a number n and optionally a time or time period.

This information is located preferably on the separating elements in a form such that a person is able to read it with the naked eye. It may additionally be printed in machine-readable form, for example as a bar code or in an RFID chip.

The sorting installation inscribes a separating element, for example by printing onto the separating element. It is also possible that the sorting installation automatically prints a label with the aforementioned information and sticks the printed label to the separating element. In one embodiment, the separating elements are in the form of electronic labels with a display surface. Such labels are, for example, disclosed in DE 102004037363 A1. The sorting installation inscribes these electronic labels in a contact-free manner. The labels do not require an electrical power supply in order to represent the information in machine-readable form on the display surface. A power supply is only required to store new information on the display surface. The use of electronic labels makes it possible to keep the information available both in a form which may be read by a person and in a data format in the label which may be evaluated automatically by a computer.

The postal items and separating elements are ejected such that the following is achieved: after ejection initially a separating element is present in a discharge container which is inscribed with a destination zone ZG-1, a number n−1 and a time or time period Z-1. Directly behind the separating element follow n−1 postal items, which are all provided with a delivery address, which belong to the destination zone ZG-1. These postal items have been ejected at the time or time period Z-1. Subsequently, a separating element follows which is inscribed with a destination zone ZG-2, a number n−2 and a time or time period Z-2. Directly behind the separating element follow n−2 postal items, which are all provided with a delivery address which belong to a destination zone ZG-2. These postal items have been ejected at the time or in the time period Z-2.

This result of the sorting makes it possible to transport the postal items further with little manual effort. The separating element displays where the postal items, which are located directly in front of this separating element, are to be transported. The previous separating element in the sequence—or a defining wall of the dispensing container—displays where a partial stack comprising the postal items to a destination zone starts. The separating element behind the partial stack is inscribed with the destination zone for the partial stack.

It is not required to remove a postal item of the partial stack from the dispensing container and to analyze it to establish, when removing a partial stack from a dispensing container, where this partial stack has to be transported—the respective separating element behind the partial stack supplies this information. Moreover, the invention eliminates the need to subsequently manually count how many postal items have to be transported to this destination zone and thus are contained in the partial stack.

The sorting installation carries out a plurality of sorting passes, in order to sort the postal items such that they are arranged after sorting in the dispensing containers in the form described above. This sorting result may only be achieved by a plurality of sorting passes, although the sorting installation has fewer dispensing containers than there are destination zones present. The postal items may be completely unsorted before the first sorting pass.

In the exemplary embodiment, each postal item passes through the sorting installation twice. The postal items are initially supplied to the sorting installation in any sequence. In the case of flat postal items, a feeder separates the postal items. Said postal items then pass through the sorting installation in succession. In the first sorting pass, the scanner scans the delivery address of each postal item as described above and detects the destination zone of this delivery address. The sorting installation temporarily stores the detected destination zone. Depending on the destination zone the sorting installation ejects the postal item into one of the dispensing containers.

In one embodiment, the sorting installation temporarily stores the detected destination zone by a printer of the sorting installation printing a bar code or a two-dimensional matrix code onto the postal item. This bar code and/or this matrix code encodes the destination zone. A bar code scanner in the second sorting pass scans bar codes of each printed bar code and decodes said bar code. As a result, the destination zone is detected.

In a further embodiment, a unique code is generated for each postal item which passes through the sorting installation in the first sorting pass. This code differentiates this postal item from all other postal items which pass through the sorting installation in a predetermined time period. In a central data bank, one respective data set is generated for each postal item. This data set comprises the generated code as well as the destination zone of the postal item, which has been detected in the first cycle. A bar code is printed onto the postal item which encodes the code. Preferably, this bar code and/or this matrix code contains no information about the destination zone. In the second sorting pass, the bar code scanner in turn scans the bar code and/or the matrix code and decodes said bar code. As a result, the code is determined. The data set comprising this code is identified in the data bank. The sorting installation uses the destination zone which is contained in this data set in the second sorting pass as the destination zone of the postal item.

In a third embodiment, the sorting installation provides the postal items neither with a bar code nor with a matrix code or such a printed item. Instead, the sorting installation in the first sorting pass measures values of characteristic parameters of the postal item, for example the distribution of color tones, dimensions, the position of the address block or the type and color of the franking mark. The sorting installation generates a feature vector by means of the measured values of these parameters. In turn a unique code and a data set are generated in the central data bank for the postal item. The data set comprises the code, the detected destination zone as well as the feature vector for this postal item. In the second sorting pass the sorting installation measures again the respective feature vector of each postal item. It compares the measured feature vector with the feature vectors of the data sets which are stored in the central data bank. The data set with the most similar feature vector belongs to the postal item and supplies the destination zone. Such a method is, for example, disclosed in DE 4000603 C2.

After the sorting installation has completed the first sorting pass, all postal items are again supplied to the sorting installation. In this case, a sequence is predetermined in which the dispensing containers are emptied and the postal items supplied again to the sorting installation. Initially, the postal items are supplied again to the sorting installation from the dispensing container AB-1, then the postal items from the dispensing container AB-2 and so forth. The postal items from a dispensing container are supplied again in any sequence to the sorting installation.

The sorting installation initially processes, in the second sorting pass, the postal items which it has ejected in the first sorting pass into the dispensing container AB-1, then the postal items from the dispensing container AB-2 and so forth. The sorting installation detects for each postal item the destination zone thereof. This destination zone has been detected in the first sorting pass and thus temporarily stored as mentioned above. In the second sorting pass, the sorting installation detects this temporarily stored destination zone. It would be far too complicated, in the second sorting pass, to scan the delivery address again, thus the temporarily stored result from the first sorting pass is used again.

The sorting installation ejects in the second sorting pass the postal items again into the dispensing container and namely depending on the respective destination zone. After the second sorting pass, the postal items as well as the separating elements are arranged in the dispensing containers as described above. Each separating element carries information about how many postal items, and for which destination zone, are located in front of the separating element in the dispensing container.

In one embodiment, the sorting installation uses the same dispensing containers in both sorting passes. In a further embodiment, the sorting installation ejects the postal items in the first sorting pass into a first quantity of dispensing containers and the postal items and separating elements in the second process into a second quantity of dispensing containers. It is possible that the two quantities are disassociated, i.e. no dispensing container is used both in the first and in the second sorting pass. It is also possible that at least one dispensing container is used in both sorting passes, at least one dispensing container only in the first sorting pass, and at least one dispensing container only in the second sorting pass.

The sorting installation preferably uses the same computer-accessible sorting plan in both sorting passes. This sorting plan assigns to each destination zone respectively one dispensing container for the first sorting pass and respectively one dispensing container for the second sorting pass. Moreover, the sorting plan establishes in which sequence the dispensing container after the first sorting pass has to be emptied and which postal items contained therein have to be again supplied to the sorting installation. The sorting installation automatically uses this sorting plan in order to decide, depending on the respective destination zone, into which dispensing container a postal item in the first sorting pass has to be ejected and into which dispensing container this postal item has to be ejected in the second sorting pass. A method is disclosed in EP 0948416 B1 in order to improve such a sorting plan by means of simulation.

It is described hereinafter how the separating elements are introduced into the sorting process.

Preferably no separating elements are used in the first sorting pass. After the first sorting pass, the sorting installation detects how many separating elements are required in the second sorting pass. The information which the sorting installation requires for this calculation is available after the first sorting pass.

N is the number of dispensing containers into which the sorting installation ejects the postal items in the second sorting pass. This information is fixed in the sorting plan. Where AB-1, . . . , AB-N are these N dispensing containers. The sorting plan contains for each of the N dispensing containers one respective identification mark of the dispensing container, which the sorting installation automatically evaluates. If two sorting passes are carried out, and N1 dispensing containers are used in the first sorting pass N1, the sorting installation is able to sort postal items for a maximum of N1*N different destination zones.

Where i=1, . . . , N ZG[1], . . . , ZG[m(i)] are those destination zones, which the sorting plan for the second sorting pass assigns to the dispensing container AB-i. In the second sorting pass, therefore, each postal item, the delivery address thereof belonging to one of the destination zones ZG[1], . . . , ZG[m(i)], may be ejected into the discharge container AB-i. As some destination zones regularly occur more frequently than others, it is possible to differentiate m(i) for different dispensing containers AB-i, i.e. for example the letters for two destination zones are ejected into one dispensing container and those for twenty destination zones into a further dispensing container.

Where i=1, . . . , N and j=1, . . . , m(i) number (i,j) is the number of postal items which are to be transported into the destination zone ZG[j]. This number is fixed after the first sorting pass. In the preferred embodiment, a separating element is only inscribed with an identification mark of a destination zone, when at least one postal item is to be transported into this destination zone, when therefore the number (i,j) >=1.

Postal items to a maximum m(i) of destination zones are ejected into the dispensing container AB-i. As it is possible that for a few destination zones, no postal items are present at all, the following separating elements are required in the dispensing container AB-i:

card {j=1, . . . , m(i)| number(i,j)>=1}

In this case, card (A) denotes the number of elements of a quantity A.

In total, therefore, the number of separating elements which are required is, $$\sum_{i=1}^{N} \text{card}\{j = 1, \ldots, m(i) \mid \text{number}(i, j) >= 1\}$$

In one embodiment, the sorting installation comprises a storage container for non-inscribed separating elements. In the second sorting pass, the sorting installation removes the required separating elements and inscribes them with the aforementioned information.

An alternative embodiment eliminates such a storage container in the sorting installation. Non-inscribed separating elements are supplied before and/or during the second sorting pass to the sorting installation. Preferably, they are supplied to the feeder of the sorting installation in the same manner as the postal items. It is not necessary to count beforehand how many separating elements are required. Instead, any number of separating elements are supplied to the feeder. The sorting installation transports these separating elements together with the postal items through the sorting installation. As the separating elements are visually distinguishable from the postal items, the scanner is able to differentiate between separating elements of postal items. For example, a separating element is differentiated as it has neither a delivery address nor a printed identification mark for a destination zone.

The sorting installation counts how many separating elements have actually been supplied to the feeder. This number is compared with the required number. If separating elements are missing, the sorting installation requests further separating elements. For example, the sorting installation generates a message that further separating elements have to be supplied.

The sorting installation only generates this message, for example, shortly before the time at which separating elements are missing. Then there is still enough time for an operator to be able to increase the number of separating elements. On the other hand, the sorting installation does not need to transport the separating elements any longer than required through the sorting installation or to store them temporarily in a buffer store.

This message contains the number of separating elements required (difference between the number of separating elements required and the number of separating elements already supplied). In a further embodiment, only one message is generated, to the effect that further separating elements have to be supplied, but not which, for example in the form of an acoustic and/or visual warning.

The sorting installation combines the separating elements and postal items for a dispensing container to form the above-described sequence, so that the separating element which is inscribed with a description of this destination zone, follows directly behind all postal items to one destination zone. The sorting installation successively ejects the postal items and separating elements in this sequence into the dispensing containers. It is possible that a plurality of postal items are ejected in an overlapping manner, in order to avoid distortion of these postal items.

The invention claimed is:

1. A method for automatically sorting a plurality of articles according to a feature by a sorting installation including a measuring device and a plurality of dispensing containers, comprising:

each article passes through the sorting installation at least twice, during a first passage of each of the plurality of articles:

determining a value relating to the feature for the respective article by the measuring device, and temporarily storing the determined value;

inscribing a separating element with an identification mark for each determined value;

during each passage:

during each passage, each of the plurality of articles are ejected into one of the plurality of dispensing containers based on the determined value;

during the last passage, ejecting the separating element and at least a portion of the plurality of articles such that for each of the plurality of dispensing containers, which includes at least one of the plurality of articles, all of the plurality of articles with the same value are arranged directly behind one another followed by the separating element with the identification mark for the respective value, wherein the ejected articles after each passage, apart from the last passage, are supplied again to the sorting installation.

2. The method as claimed in claim 1, further comprising:

by the sorting installation:

establishing which value the measuring device has determined at least once, and for each determined value, inscribing one identifying element with an identification mark for the respective value.

3. The method as claimed in claim 1, further comprising:

by the sorting installation:

applying a computer-available sorting plan which establishes, for each value, into which dispensing of the plurality of containers an article is to be ejected with this value, and for each value occurring in the sorting plan inscribing one respective separating element with an identification mark for this feature value.

4. The method as claimed in claim 1, further comprising:

by the sorting installation for each possible value:

counting how many of the plurality of articles for which the respective values has been determined, and inscribing the separating element for the respective value with a number of articles counted for which the respective value has been determined.

5. The method as claimed in claim 1, further comprising:

by the sorting installation:

determining how many separating elements are required for ejecting the articles, counting how many separating elements are actually available, and activating a handling process by which missing separating elements are made available when fewer separating elements are available than required.

6. The method as claimed in claim 1, further comprising:

by the sorting installation:

detecting, for at least one determined-value, a time when each of the plurality of articles with this value are ejected, and providing the separating element for this value with an identification mark for the ejected time.

7. The method as claimed in claim 1, wherein each of the plurality of articles and each of the plurality of separating elements are an object, both the articles and the separating elements are moved one after the other into a position in which the measuring device determines the value relating to the feature for the respective object, and the measuring device decides for each object whether the object is one of the plurality of articles with the feature or one of the separating elements.

8. The method as claimed in claim 7, wherein the sorting installation transports every object which the measuring device has identified as a separating element into a buffer store and removes the object again from the buffer store for ejection.

9. The method as claimed in claim 1, wherein each article is provided with an identification mark for a destination zone, the measuring device scans the respective destination zone of each article, the sorting installation uses the scanned destination zone as the value of this article, and all articles with an identification mark of the same destination zone are transported together to this destination zone.

10. The method as claimed in claim 1, wherein different types of articles have to be sorted, and as the value of each article, the type thereof is determined and is used for ejection.

11. The method as claimed in claim 1, wherein differently colored articles have to be sorted, and as the value of each article, the color thereof is determined and is used for ejection.

* * * * *